US009702164B2

(12) United States Patent
Benninger

(10) Patent No.: US 9,702,164 B2
(45) Date of Patent: Jul. 11, 2017

(54) TENT

(71) Applicant: Gary N. Benninger, West Bloomfield, MI (US)

(72) Inventor: Gary N. Benninger, West Bloomfield, MI (US)

( * ) Notice: Subject to any disclaimer, the term of this patent is extended or adjusted under 35 U.S.C. 154(b) by 354 days.

(21) Appl. No.: 13/653,428

(22) Filed: Oct. 17, 2012

(65) Prior Publication Data

US 2014/0102496 A1 Apr. 17, 2014

(51) Int. Cl.
*E04H 15/54* (2006.01)

(52) U.S. Cl.
CPC ..... *E04H 15/54* (2013.01)

(58) Field of Classification Search
CPC ..... E04H 15/42
See application file for complete search history.

(56) References Cited

U.S. PATENT DOCUMENTS 3,445,970 A * 5/1969 Nelson ..... E04B 1/34378 52/71
3,640,034 A * 2/1972 Shotwell, Jr. ..... E04B 1/3211 52/70
4,308,882 A * 1/1982 Pusch et al. ..... 135/93
4,529,633 A * 7/1985 Karlsson ..... 428/17
5,732,514 A * 3/1998 Organ ..... E04B 1/3211 52/80.1
5,750,242 A * 5/1998 Culler ..... 428/209
5,955,175 A * 9/1999 Culler ..... 428/209
6,061,969 A * 5/2000 Leary ..... A01G 9/1415 52/2.11
6,127,007 A * 10/2000 Cox et al. ..... 428/15
6,470,901 B1 * 10/2002 Scherer ..... 135/136
6,658,800 B2 * 12/2003 Monson ..... E04B 1/3211 52/81.1
7,462,321 B2 * 12/2008 Udin ..... B29C 33/308 264/316
2005/0058790 A1 * 3/2005 Simon ..... B32B 27/32 428/35.7
2005/0118915 A1 * 6/2005 Heifetz ..... 442/378
2009/0047483 A1 * 2/2009 Sugahara et al. ..... 428/195.1
2009/0233508 A1 * 9/2009 Kubota ..... C08J 5/24 442/287
2009/0291281 A1 * 11/2009 Hanket ..... 428/220
2011/0100547 A1 * 5/2011 Kelsey et al. ..... 156/278
2011/0315180 A1 * 12/2011 Kanayama ..... 135/115
(Continued)

*Primary Examiner* — David R Dunn
*Assistant Examiner* — Danielle Jackson
(74) *Attorney, Agent, or Firm* — Dickinson Wright PLLC

(57) ABSTRACT

A tent constructed such that it incorporates a light-weight, single walled, low emissivity fabric or film canopy. In the case of the polymer film canopy, the canopy may be assembled from flat or molded film segments/sections. The light-weight canopy materials may incorporate a grid of reinforcing fibers, wherein the reinforcing fibers are laminated into/onto the film during manufacture of the film/fabric. The light-weight canopy materials, either with or without a grid of laminated reinforcing fibers, may also incorporate additional continuous reinforcing fibers added to the canopy materials during the tent manufacturing process by bonding along the lines of principal stress/load. The possibility of including the continuous fibers along the principal lines of stress/load during the laminating process is also addressed.

15 Claims, 6 Drawing Sheets

(56) References Cited

U.S. PATENT DOCUMENTS

| | | | | |
|---|---|---|---|---|
| 2014/0060599 | A1* | 3/2014 | Hotes et al. | 135/91 |
| 2014/0134378 | A1* | 5/2014 | Downs | A43B 23/0225 428/57 |
| 2014/0190540 | A1* | 7/2014 | Herpin et al. | 135/115 |
| 2014/0272349 | A1* | 9/2014 | Di Sante et al. | 428/213 |

* cited by examiner

TENT

FIELD

The present disclosure relates generally to tents and, more particularly, tents constructed of a low emissivity flat or molded polymer film having laminated reinforcing fibers, none, some or all being located along directions of principal stress.

BACKGROUND

This section provides background information related to the present disclosure which is not necessarily prior art.

A tent typically includes a water resistant, breathable canopy with an attached waterproof, non-breathable floor and a waterproof, non-breathable fly that covers the canopy while allowing an interstitial air space between the two. A system of pole sections is assembled to provide support for the canopy and fly. The poles often have internal shock cording or similar elastic material to interconnect each group of pole segments together and to aid in the assembly of the role segments. One or more poles are typically required to support the tent. Depending on the design, tents can use a combination of poles and guys to support the tent or, in some cases, multiple poles have been configured to allow the tent to be free-standing.

For backpacking, mountaineering and military applications, the lightest possible fabrics providing sufficient strength and protection are used for tents. Historically, the fabrics used for these tents include, but are not limited to, coated and uncoated woven nylons and polyesters. The tent usually has a series of peg loops that are provided near ground level around the periphery for the purpose of securing the tent to its mounting platform, albeit the earth, snow or any other suitable mounting surface. Often, the guy loops are attached at strategic locations on the outside of the tent to allow guy lines to be attached to the tent to further secure it to its mounting platform. Many older, simpler tents were made using water repellant cotton-based fabrics and or fabrics treated with waxes or chemicals to make an otherwise non-water repellant fabric, water repellant. These tents often had no floors. Waterproof flys were sometimes used in extreme, wet conditions.

More recently, there has been a growing trend toward single walled tents using only one layer of light-weight, waterproof material. This can be achieved by using the fly only, which now also becomes the canopy, without the inner tent or by using a light-weight waterproof material for the tent canopy, thus eliminating the fly. These single-walled tents have the advantage of being lighter in weight than those using both a canopy and a fly. However, these types of tents have two major disadvantages, the first being that waterproof materials do not breath, i.e., let air pass through them, and thus can present a suffocation hazard. This disadvantage can be addressed by providing sufficient adjustable openings for air ventilation. The second disadvantage is that once the temperature of the waterproof canopy drops below the dew point, moisture will start to condense out of the surrounding air onto the canopy. This can happen on both the inner and outer surfaces of the canopy and will depend primarily on the canopy material temperature and the humidity of the air near its surface. In a canopy-fly type of tent, such condensation can also occur but typically only on the fly. Since the canopy material is on the occupant side of the fly, the occupant does not come in contact with the condensation.

Accordingly, a need exists to advance the design and construction of light-weight and shape stable tents by the use of alternative materials, such as reinforced polymer films. To this end, the present disclosure describes how this technology can be used in the construction of backpacking and mountaineering tents to achieve very light weight yet strong tents.

SUMMARY

It is an aspect of the present teachings to provide a tent that is lighter and stronger while overcoming the disadvantages of a single layer canopy tent design.

In accordance with this and other aspects, the present disclosure is directed to light-weight, single and double walled tents, with and without integral floors, which incorporate low emissivity fabric or film canopy materials. The present disclosure also is directed to such tents where the canopy is made from a flat or molded polymer film.

The present disclosure also is directed to such tents that also may incorporate additional fiber reinforcement into the polymer canopy wherein the reinforcing fibers are laminated into the film or fabric and/or added to the canopy by bonding in a tape like fashion along the lines of principal stress/load.

Further areas of applicability will become apparent from the description and claims herein. The description and specific examples in the disclosure and summary are intended for purposes of illustration only and are not intended to limit the scope of the present invention.

DRAWINGS

The drawings described herein are for illustrative purposes only of selected exemplary embodiments and are not intended to limit the scope of the present disclosure in any way. Similar or identical elements are given consistent reference numerals throughout the various figures.

Reference now will be made to the accompanying drawings in which.

Figure 4A:
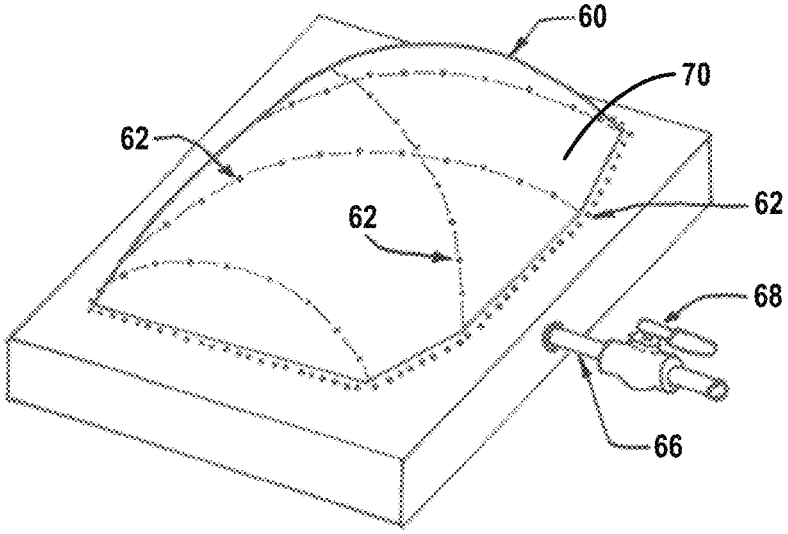
Figure 4B:
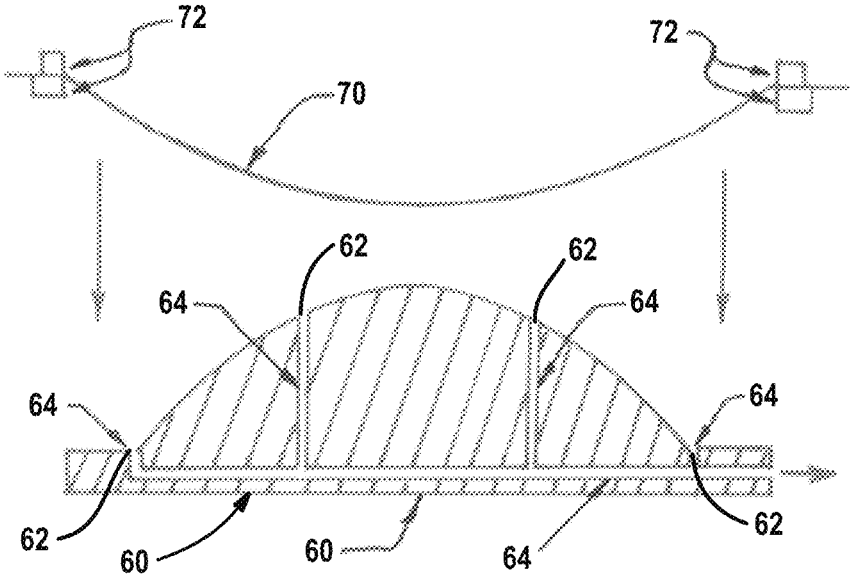
Figure 4C:
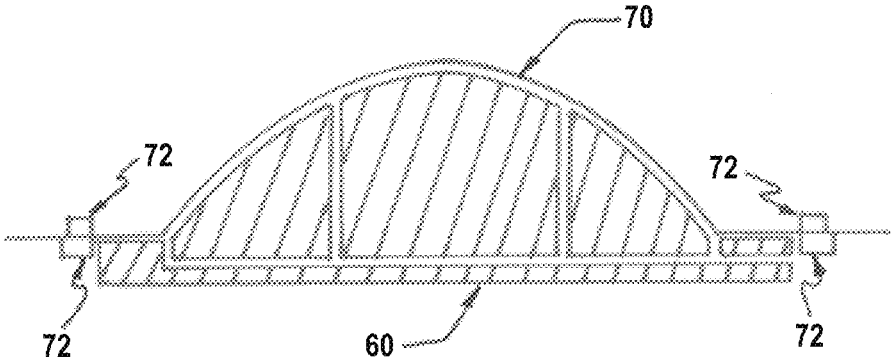
Figure 5:
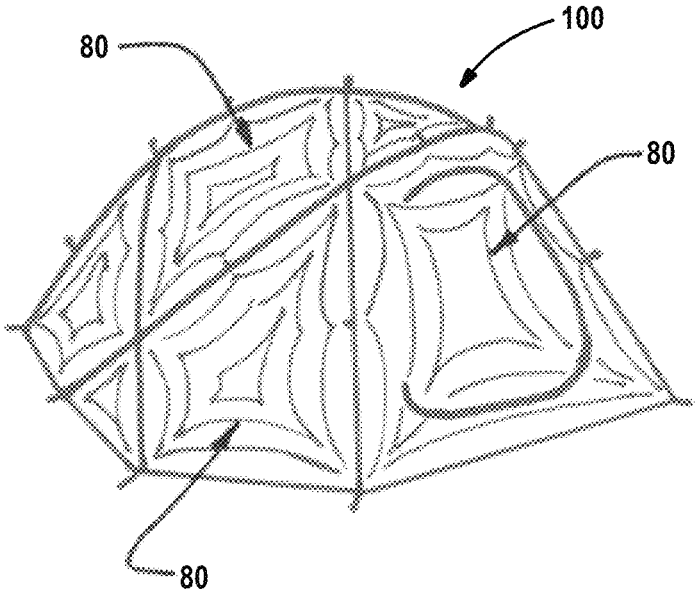

FIGS. 4A through 4C illustrate exemplary views of a typical tent canopy segment mold and a method of forming the film on the mold using a thermoforming process; and FIG. 5 illustrates an exemplary view of a typical single layer backpacking or mountaineering tent fabricated of low emissivity film that may or may not have internally laminated reinforcement, and has continuous fiber tapes bonded to in along the principal lines of stress/loading.

DETAILED DESCRIPTION

The following exemplary embodiments and theoretical description are provided so that the present disclosure will be thorough and fully convey the scope to those skilled in the art.

Figure 1A:
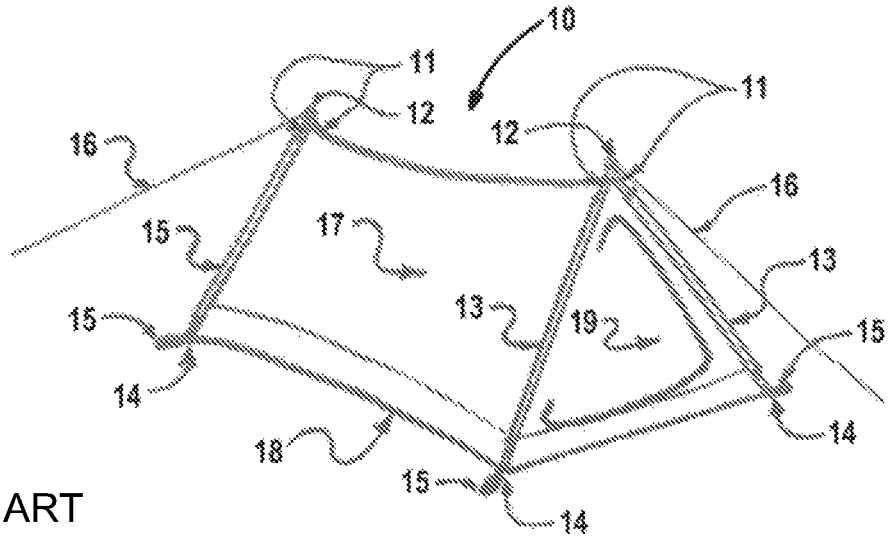
PRIOR ART FIG. 1A
FIGS. 1A and 1B illustrate two exemplary views of a typical A frame backpacking or mountaineering tent.

Referring to FIG. 1, two views of an exemplary backpacking or mountaineering tent 10 that has been built using the well-known "A-Frame" type of design construction is shown. In FIG. 1A, the tent 10 is shown without a fly to better note the construction details. The tent 10 is supported at both ends by a pair of rigid poles 11. Each pole 11 is comprised of several pole segments joined internally with an elastic shock cord, with a joining fixture 12 provided at their upper end. The poles 11 are slipped into sleeves 13 provided at both ends of the tent 10. On their lower ends, each pole 11 is fitted into a grommet 14 that has been placed in the lower edge of the tent 10 or in a tent peg pullout 15 attached to the lower edge of the tent 10. On the upper end, the poles 11 are connected by the joining fixture 12 which allows a guy line 16 extending from the apex of the tent 10 to pass through or over it. As such, the guy lines 16, in opposing directions, on both ends of the tent 10, pull the tent 10 taught between the two A Frames.

The upper part of the tent 10 is referred to as the canopy 17. The canopy 17 of the tent 10 shown in FIG. 1 is preferably constructed of water repellant, but not waterproof, breathable material. The tent 10 may or may not have a floor 18. If it does, the floor 18 will be made of a waterproof material and will join the canopy 17 at the bottom edge or some distance up the side, 6 to 8 inches for example. The floor 18 is often extended up the sides of the tent 10 to protect from splashing water. One or more zippered doors 19 are used for ingress and egress to the tent 10.

Figure 1B:
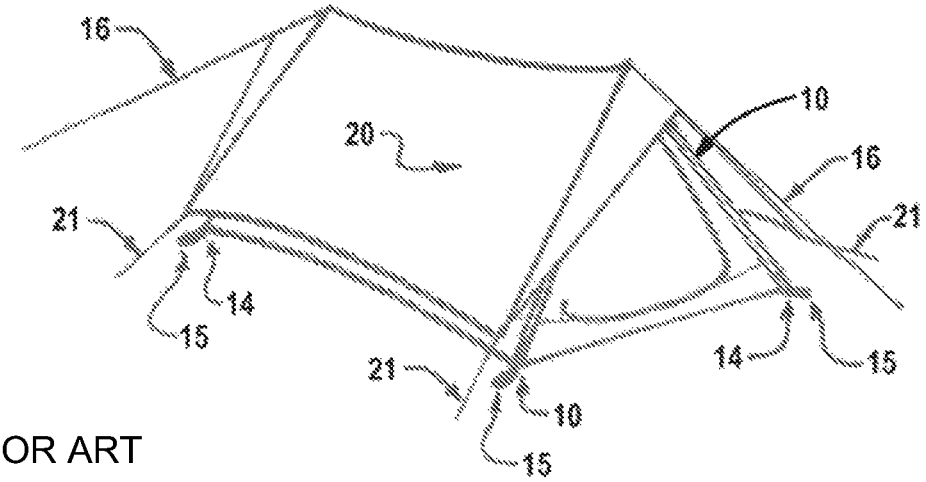
PRIOR ART FIG. 1B

In FIG. 1B, the tent 10 of FIG. 1A is shown with the protective waterproof fly 20 in place. The fly 20 rests on the tent framework and is anchored at its lower edges using guy lines 21. The design is such that the fly 20 does not touch the canopy 17 and is separated from it by an air space, thus allowing the circulation of air between the fly 20 and the canopy 17. The fly 20 is preferably made of completely waterproof material. It should be noted at this point that the canopy 17 could have also been made of waterproof material, thus eliminating the fly 20. Doing this introduces two problems that will forthwith be addressed in accordance with the teachings set forth in this disclosure.

Figure 2A:
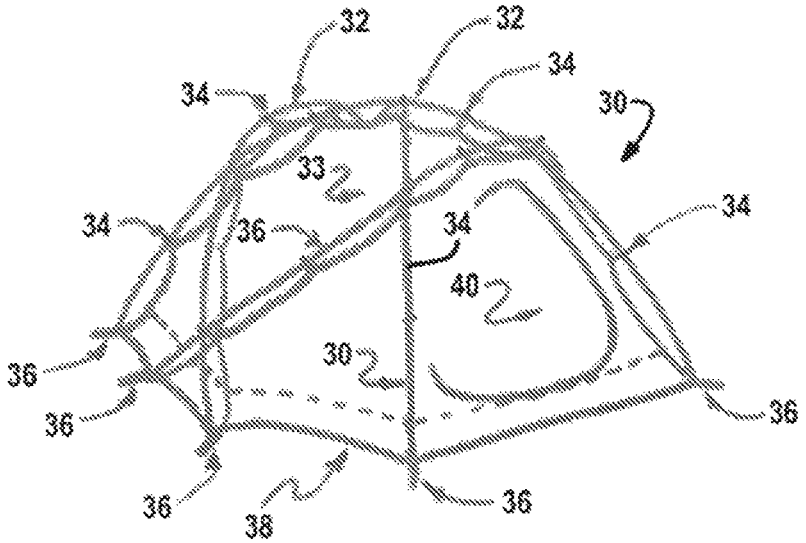
PRIOR ART FIG. 2A
FIGS. 2A through 2C illustrate several exemplary views of a typical Free-Standing backpacking or mountaineering tent.

Referring to FIG. 2, three views of an exemplary backpacking or mountaineering tent 30 that has been designed using the well-known "Free Standing" type of construction are shown. In FIG. 2A, the tent 30 is shown without a fly to better note the construction details. The tent 30 is supported by a series of flexible poles 32, made up of pole segments held together with an elastic shock cord, that are arranged so that the canopy 33 of the tent 30 is completely supported. As such, the tent 30 does not typically require the use of guy lines, thus the term Free Standing. However, in windy conditions, guy lines can be employed for additional stability. The poles 32 may be inserted in a series of fabric tubes (not shown) provided as in the A Frame tent versions shown in FIGS. 1A and 1B, or instead a series of hooks 34 may be used to attach the canopy 33 to the poles 32. The ends of the poles 32 are secured in a grommet or similar device in a peg pullout 36 or in a built-in flange on the tent 30. Hooks have been selected for this example and are shown in FIG. 2A. Similar to the A Frame tent 10, the Free Standing tent 30 has a canopy 33, a floor 38 and one or more zippered entrances 40.

Figure 2B:
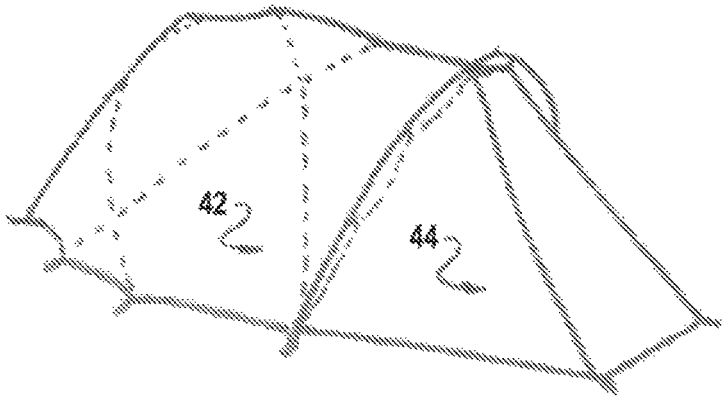
PRIOR ART FIG. 2B
Figure 2C:
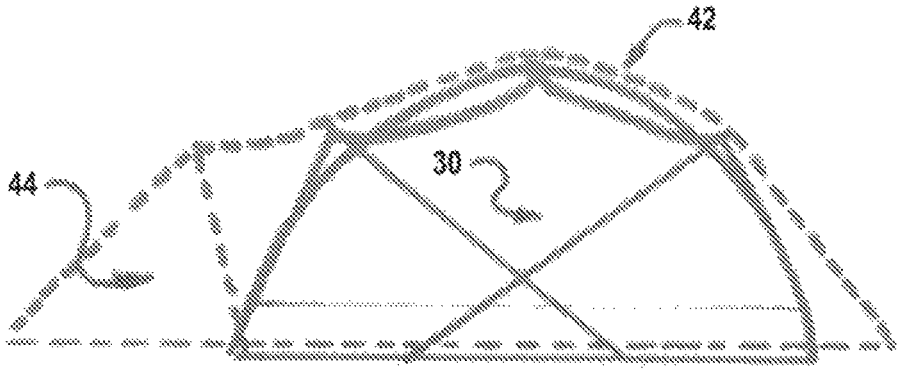
PRIOR ART FIG. 2C

In FIG. 2B, a much more fitted fly 42 is shown stretched over the underlying pole/canopy/floor structure of the tent 30. In this case a vestibule 44, exterior to the canopied interior structure has been created. Here equipment may be stored for protection from the environment. This vestibule 44 is clearly noted in FIG. 2C which shows the outline of the inner tent 30 and the covering fly 42.

The following theoretical description is provided so that along with the additional exemplary embodiments that follow, the present disclosure will be thorough and fully convey the scope to those skilled in the art. Fundamental theoretical details and other numerous specific details are set forth such as examples of specific components, devices and schematic configurations to provide a thorough understanding of exemplary embodiments of the present disclosure. However, it will be apparent to those knowledgeable in the underlying theory and skilled in the art that these specific details need not be employed, that the exemplary embodiments may be embodied in many different forms, and that neither should be construed to limit the scope of the present disclosure.

As mentioned earlier, making the tent canopy of a waterproof material for eliminating the fly reduces weight but results in two major disadvantages, the first being that waterproof materials do not breath, i.e., let air pass through them, and thus can present a suffocation hazard. This disadvantage can be addressed by providing sufficient adjustable openings for ventilation. The second disadvantage is that when the temperature of the waterproof canopy drops below the dew point, moisture can condense out of the surrounding air onto the canopy. This can happen on both the inner and outer surfaces of the canopy and will depend on the canopy material temperature and the humidity of the air near its surface. In a canopy/fly type of tent, such condensation can also occur, but typically occurs only on the fly. Since the canopy material is on the occupant side of the fly, the occupant does not come in contact with this condensation.

Since condensation on the interior and/or exterior surface of the canopy is a result of the canopy dropping below the dew point, this disclosure teaches that this temperature drop can be minimized by constructing the canopy from materials that have a low emissivity. Since the canopy temperature will normally want to adjust to the temperature of the surrounding air, as would any inanimate object, by means of conduction and convection, the loss of heat that causes the canopy to drop below the ambient air temperature is due to heat transfer by radiation. It is a well know law of Physics that heat transfer by radiation is governed by the Stefan-Boltzmann Law, $$Q=\epsilon\sigma T^4 \qquad \text{Eq. 1}$$

where Q is the heat transferred, $\epsilon$ the emissivity of the radiating body, $\sigma$ the Stefan-Boltzmann Constant and T the absolute temperature (in Kelvin) of the object/space that is emitting or absorbing the radiation. In the case of a tent on a warm summer night with the air at 60° F., T would be equal to 288.6 K. If the tent were pitched in an open field and the sky were clear, the tent would be radiating to open space that has a temperature of approximately 4.2 K. The heat transfer from the warmer to the colder body is driven by the difference between the fourth power of the two temperatures. In this case the heat loss is significant. If the tent were under a tree, it would be radiating to the tree which would have a temperature near ambient. In this case, there would be very little if any heat lost from the canopy. From Eq. 1, it is readily understood that minimal heat transfer by radiation, even in the case where the tent surface is radiating to extremely low temperature bodies/spaces, can be achieved by using materials having low emissivities. The emissivity of a radiating body/space can have a value from 1 down to small values approaching zero. Black bodies exhibit emissivities near 1 while shiny metallic bodies exhibit low exissivities in the order of 0.1 or less. Thus, to achieve minimal heat loss, the tent canopy should be made of a material exhibiting the properties of a shiny metallic surface. Well known light materials that can achieve this result are metalized polymer films. This is the theory behind the well know space blanket technology. Preferably, a light-weight polymer film may be used in this tent construction application. It should be noted that polyester films are commercially available and are ideal materials for this application. One particular material well suited for construction of tents often goes by the trade name Mylar®.

Since use of a low emissivity material for the tent canopy will result in a tent having near infrared radiation signature suppression, a tent incorporating these teachings would be beneficial for use by the military.

Thin films that by themselves would not have sufficient strength for such tent applications may be strengthened by bonding reinforcing fibers to the film. For example, reinforced film materials are available today and have been used in sailboat sails. One brand of reinforced films adapted for use in such sailboat sail applications are manufactured by Cubic Tech Corp. The reinforced film products that are produced by Cubic Tech Corp. are designated $CTF^3$. In the $CTF^3$ reinforced films, the fibers are often laid in as a grid in two directions perpendicular to each other, often designated 0°/90°. This and other reinforced film materials are available where additional fibers of the grid are laid at 45° angles to the 0°/90° case which results in a 0°/90°/+45°/−45° configuration. Other fiber grid arrangements are also possible, including a completely random arrangement of the fibers, so as to result in a fabric having isotropic or equivalent strength in all directions within the plane of the film/fabric. However, in all cases, rows of parallel fibers or random fibers are laminated to the film on a single side or sandwiched between two film layers.

The teachings of the present disclosure address the use of low weight films, both with and without low emissivity treatments that have been pre-laminated with reinforcing fibers, as well as such films that have not been pre-laminated with reinforcing fibers. In some cases, it may be necessary to custom make the desired films by depositing low emissivity coatings on existing low weight films, if the appropriate weight coated film is not commercially available. When using pre-laminated films, the tent surface segments comprising the canopy and floor (if incorporated) are cut and assembled to the final shape by sewing, taping, or gluing or by some combination of these methods. Additional fibers may be applied to the tent surfaces either before of after assembly to achieve additional strength along lines of stress. These fibers may be in the form of tapes or may be laid onto the surface with other adhesive methods.

Since polyester is a thermoplastic, the polyester films that are reinforced (or ones that are reinforced with thermoplastic fibers) and can be preformed prior to assembly using heat. Two different methods will be described herein.

Figure 3A:
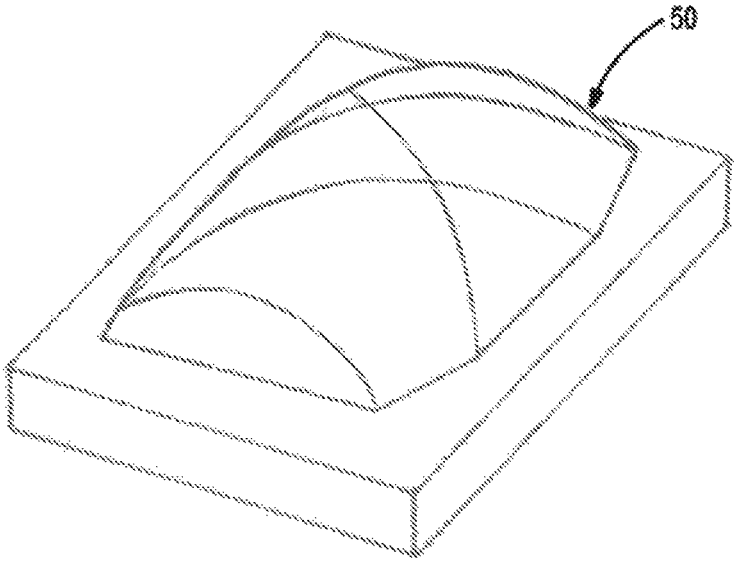
FIGS. 3A and 3B illustrate exemplary views of a typical tent canopy segment mold and forming the film on the mold using external heating.
Figure 3B:
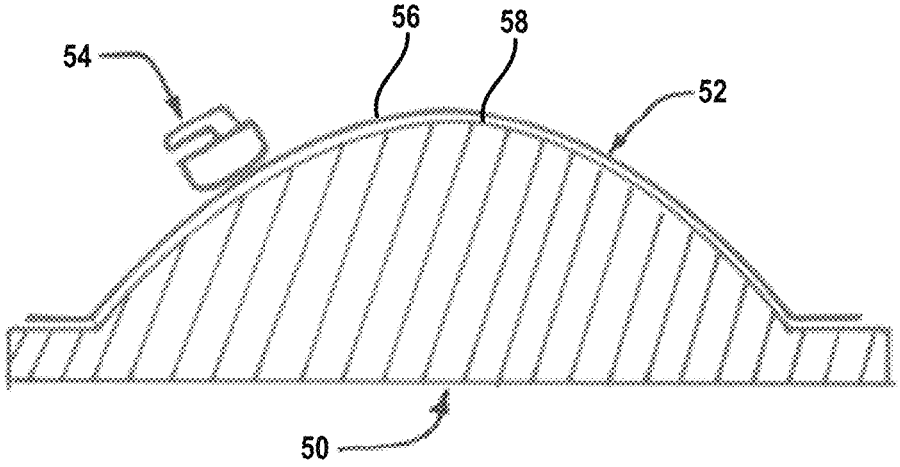

In accordance with a first method of manufacturing component portions of a tent or canopy, a mold or form 50, a representative example being shown in FIG. 3A, having the shape of a segment of the tent 30 is constructed. The mold 50 may be constructed of wood, metal or other materials or some combination thereof. Care must be taken not to select a segment of the tent 30 that requires excessive shaping of the polymer film. Depending on the film to be used, the mold 50 may require heating. This can be accomplished with internal electrical resistance heating or tubing allowing hot water to pass through the mold 50. Also, the mold 50 may be heated externally using an oven or other infrared radiation. Once the mold 50 is at the desired temperature, the polymer film 52 with or without thermoplastic reinforcing fibers is laid over the mold 50. Next, a heated soft surface iron 54 is moved along the surface 56 of the film 52 heating it and causing it conform to the surface 50 of the mold 50. A section of this final shape and the location of the film relative to the mold is shown in FIG. 3B.

In accordance with a second method, a mold 60, a representative example being shown in FIG. 4A, having the shape of a segment of the tent 30 is constructed. The mold 60 may be constructed of wood, metal or other materials or some combination thereof. Depending on the film to be used, the mold 60 may require heating. This can be accomplished with internal electrical resistance heating or tubing allowing hot water to pass through the mold 60. Also, the mold 60 may be heated externally using an oven or other infrared radiation. In addition, this mold 60 has a series of small holes 62 (note that not all holes are denoted so as not to clutter the figure) that are interconnected internally.

A labyrinth of interconnected vacuum passages 64 (see FIG. 4) are connected by a system of external piping 66 and valving 68 to a vacuum-creating device or reservoir. Vacuum passages 64 communicate with the holes 62 at the shaped mold surface 70. The purpose of the holes 62 in the mold 60 is to extract the air that is trapped between the mold 60 and the film 70 as the heated film is lowered over the mold 60. The vacuum process also results in a pressure difference between the two sides of the polymer film 70 causing atmospheric pressure to push or press the film 70 onto the mold 60. This process is well known and is commonly referred to as thermoforming.

Once the mold 60 has been heated to the desired temperature, if required, the film 70 (with or without the thermoplastic reinforcing fibers) is attached to a holding frame 72 shown in FIG. 4B and heated in an oven. After sufficient heating, as determined by the temperature of the film 70 or by the amount of sag of the film or other convenient method, the heated film 70 is lowered over the mold (which may be preheated) and a vacuum is applied to the mold 70. Valve 54 is used to open the mold vacuum passages 64 to the external vacuum pump or reservoir. The film 70 will be pushed onto the mold 60 by the difference in pressure created by the vacuum, thus assuming the shape of the mold. A section of this final shape and the location of the film 70 relative to the mold 60 is shown in FIG. 4C. Some skill will be required to avoid getting unwanted wrinkles at the edges of the film. Once cooled the formed film is removed from the mold 70 and the edges are trimmed.

In accordance with both forming methods, once cooled the series of film segments (with or without internal reinforcement) may be assembled by using adhesives, sewing and/or tapes or any combination thereof.

Once the film segments (either with or without reinforcement) are assembled, to achieve the strongest tent possible for any weight film (whether reinforced or not), continuous fiber reinforcing tapes 80 are added along the lines of principal stress. A representative example of a tent 100 having a representative number of the reinforcing tapes 80 is shown in FIG. 5 (note that not all tapes are denoted so as not to clutter the figure). The tapes 80 may be affixed to an adhesive backing material or may have heat-activated adhesive pre-coated to the fibers. In either case heat may be required to activate the adhesive. This may be done in an oven or by a soft surfaced ironing device.

This teaching further provides that In the future the process and teachings herein presented will be modified so that the continuous fiber reinforcing tapes along the lines of principal stress/load are laminated between the two polymer film layers, rather than being added externally. After forming large tent segments (the complete tent canopy if possible) of non-reinforced film by the heat-forming/thermoforming processes described herein the continuous fibers having a pre-coated heat activated adhesive are laid down upon the film while it was still on the mold. Over this a layer of finer fibers in the form of a scrim would be placed and then finally another layer of film. The soft surface ironing device would then be used to activate the adhesive, thus bonding all the layers together. If the tent were molded in more than one segment, the segments would then be joined by adhesive, sewing or tape or some combination thereof. The process thus described is used by North Sales in the construction of the previously referenced 3DL® sails. However, the more complex shape of the tent relative to the sails may impede the evolution of the process to this point.

What is claimed is:

1. A single walled tent comprising:

a tent canopy consisting of a single piece of thin thermoformed film;

said single piece of thin thermoformed film having an outside surface exposed to an environment of the single walled tent; and a plurality of reinforcement tapes secured to said single piece of thin thermoformed film for strengthening said tent canopy.

2. The single walled tent of claim 1 wherein said tent canopy has a low emissivity.

3. The single walled tent of claim 1 wherein said single piece of thin thermoformed film is comprised of a light-weight polymer material.

4. The single walled tent of claim 1 wherein said plurality of reinforcement tapes include an adhesive backing material to establish said secured relationship to said single piece of thin thermoformed film.

5. The single walled tent of claim 1 wherein said single piece of thin thermoformed film is comprised of a reinforced polymer material.

6. A single walled tent comprising:

a tent canopy consisting of a single piece of thin thermoformed film;

said single piece of thin thermoformed film comprised of a light-weight reinforced polymer;

said single piece of thin thermoformed film having an outside surface exposed to an environment of the single walled tent; and a plurality of reinforcement tapes secured to said single piece of thin thermoformed film for strengthening said tent canopy.

7. The single walled tent of claim 6 wherein said plurality of reinforcement tapes include an adhesive backing material to establish said secured relationship with said single piece of thin thermoformed polymer film.

8. A single walled tent comprising:

a tent component portion comprised of a plurality of thin thermoplastic polymer films;

a connection means for securing said plurality of thin thermoplastic polymer films to one another to establish the tent component portion;

each of said plurality of thin films of said tent component portion having an outside surface exposed to an environment of the single walled tent; and a plurality of reinforcement tapes secured to said plurality of thin films for strengthening said tent component portion.

9. The single walled tent of claim 8 wherein said connection means includes adhesive.

10. The single walled tent of claim 8 wherein said connection means includes sewing.

11. The single walled tent of claim 8 wherein said connection means includes attachment tapes.

12. The single walled tent of claim 8 wherein said plurality of thin thermoplastic polymer films are comprised of thermoformed reinforced polymer material.

13. The single walled tent of claim 8 wherein said plurality of reinforcement tapes each include adhesive backing material to establish said secured relationship with said plurality of thin thermoplastic polymer films.

14. The single walled tent of claim 8 wherein said plurality of thin thermoplastic polymer films are each comprised of a thermoformed light-weight reinforced polymer.

15. The single walled tent of claim 8 wherein said tent component portion has a low emissivity.

* * * * *